US006126388A

United States Patent [19]

Yamanaka et al.

[11] Patent Number: 6,126,388

[45] Date of Patent: Oct. 3, 2000

[54] WATER PUMP AND MANUFACTURING METHOD THEREOF

[75] Inventors: Shigeaki Yamanaka; Satsuo Morita, both of Hiroshima, Japan

[73] Assignee: Kubota Iron Works CC. Ltd., Hiroshima, Japan

[21] Appl. No.: 09/122,870

[22] Filed: Jul. 27, 1998

[30] Foreign Application Priority Data

Aug. 25, 1997 [JP] Japan ..... 9-228287

[51] Int. Cl.[7] ..... F01D 11/00

[52] U.S. Cl. ..... 415/111; 415/168.2; 415/174.2

[58] Field of Search ..... 415/111, 112, 415/113, 230, 231, 174.2, 168.2; 29/888.02

[56] References Cited

U.S. PATENT DOCUMENTS

| | | | |
|---|---|---|---|
| 3,474,733 | 10/1969 | Saletzki et al. | 103/103 |
| 3,632,220 | 1/1972 | Lansinger | 415/112 |
| 4,172,310 | 10/1979 | Mincuzzi | 29/156 |
| 4,380,416 | 4/1983 | Menager | 415/170 |
| 5,558,491 | 9/1996 | Andrews | 415/111 |
| 5,827,041 | 10/1999 | Charhut | 415/113 |

FOREIGN PATENT DOCUMENTS

| | | |
|---|---|---|
| 9-338535 | 12/1996 | Japan . |
| 9-88886 | 3/1997 | Japan . |

*Primary Examiner*—Edward K. Look
*Assistant Examiner*—James M. McAleenan
*Attorney, Agent, or Firm*—Armstrong, Westerman, Hattori, McLeland & Naughton

[57] ABSTRACT

A water pump is capable of avoiding adverse influence of water leakage from a swirl chamber to a bearing. The water pump includes a pump housing, a rotary shaft supported by a bearing mounted on a boss portion of the pump housing, an impeller fixed on an end portion of the rotary shaft extending into a swirl chamber defined within the pump housing, and a mechanical seal disposed between the impeller and the bearing. The water pump further includes a seal ring disposed within a space defined between the mechanical seal and the bearing for dividing the space into a first and second vapor chambers with drain holes provided for respective first and second vapor chambers.

3 Claims, 7 Drawing Sheets

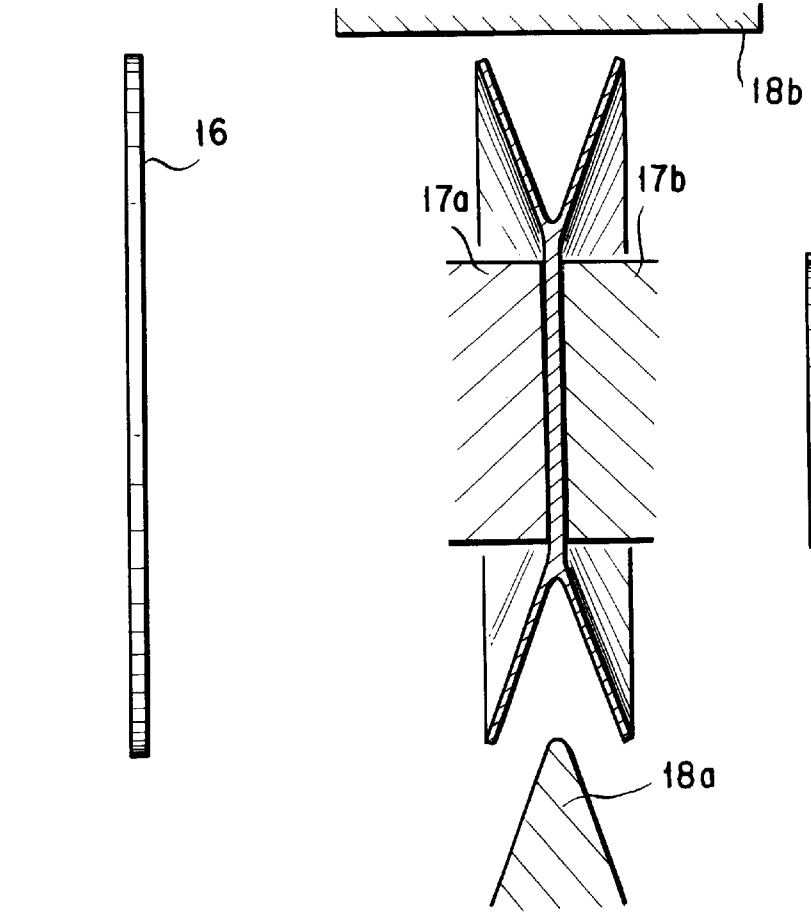
FIG. 5A
FIG. 5B
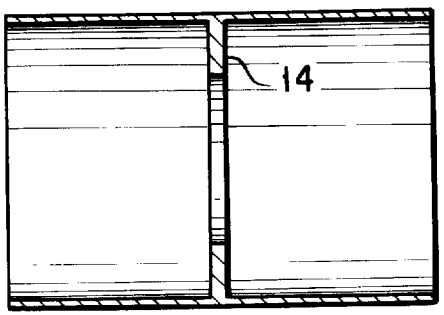
FIG. 5C
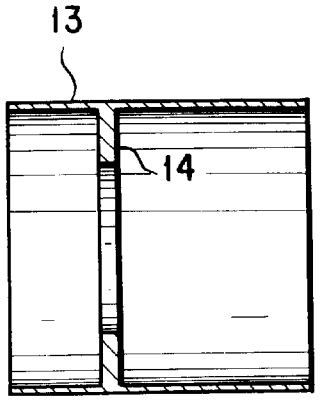
FIG. 5D

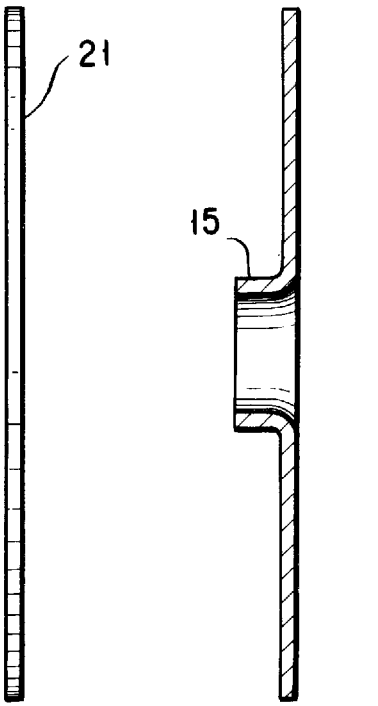
FIG. 7A
FIG. 7B
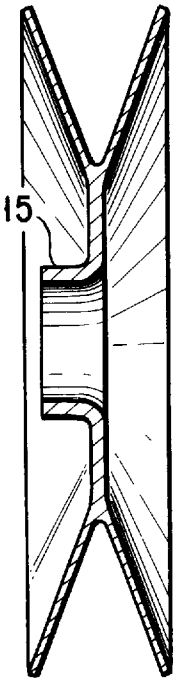
FIG. 7C
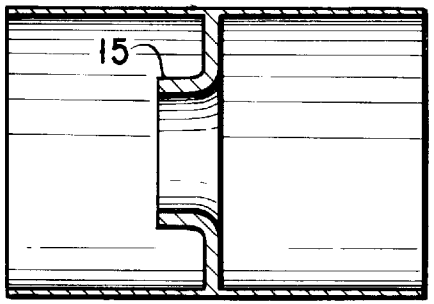
FIG. 7D
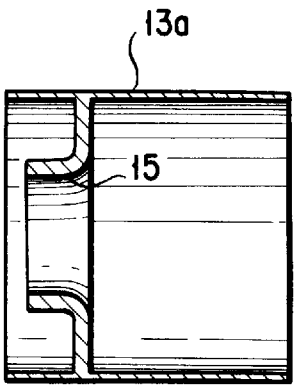
FIG. 7E

WATER PUMP AND MANUFACTURING METHOD THEREOF

BACKGROUND OF THE INVENTION

1.Field of the Invention

The present invention relates to a water pump to be used for circulating a coolant for an internal combustion engine of an automotive vehicle, or so forth. More particularly, the invention relates to a water pump and a manufacturing method of the water pump, in which an intermediate portion of a rotary shaft is supported by a bearing fitted on a boss portion of a housing, a rotary body, such as a pulley, is fixedly mounted on one end portion of the rotary shaft extending from the bearing, a pump impeller is rigidly fixed on the other end of the rotary shaft extending toward a swirl chamber of the housing, and a mechanical seal is disposed between the pump impeller and the bearing.

2. Description of the Related Art

A conventional water pump is constructed as shown in FIG. 1. A rotary shaft 1 of the water pump is supported on a pump housing 3 via a bearing 2. On a tip end of the rotary shaft 1, a pump impeller 4 is rigidly fixed. On the other hand, on a base end portion of the rotary shaft 1, a pulley hub 5 is rigidly fixed. Between the bearing 2 and the pump impeller 4, a mechanical seal 6, which is constituted of a stationary member 6*a* fixed on the side of the housing 3 and a rotary member 6*b* fixedly engaged with the rotary shaft 1, is disposed in a condition where both of the members 6*a* and 6*b* are abutted with each other by biasing sliding members thereof by means of springs. The reference numeral 7 denotes a lid body forming a swirl chamber 8 located in opposition to the pump impeller 4. The lid body 7 is fixed to the pump housing 3 by means of fastening bolts 9. While not illustrated, a suction portion and a discharge port are provided in the lid body 7.

When a temperature of an engine coolant circulated by the water pump is elevated during the use of such type of the water pump, a small amount of moisture in a form of vapor can pass through the mechanical seal 6 from the swirl chamber 8 toward the bearing 2. Such moisture can cause fatigue of a seal rubber provided on the end portion on the side of the mechanical seal of the bearing 2 or can damage the bearing.

As a solution for the problems set forth above, Japanese Unexamined Patent Publication No. Hei 8-338535 proposes a construction, in which two seal rings are proposed in parallel in spaced apart relationship, a lubricant is filled between these seal rings, and the seal ring on the side of the swirl chamber is slidable in an axial direction for establishing a balance between a pressurized water and the lubricant. Furthermore, Japanese Unexamined Patent Publication No. Hei 9-88886 proposes a construction, in which an annular sealing lip varying depression force onto the rotary shaft depending upon a pressure on the side of the swirl chamber, is disposed between the bearing and the swirl chamber.

However, in case of the former, it is inherently required that one of the sealing members is movable depending upon the pressure within the swirl chamber to make the construction and treatment troublesome to cause higher cost. Furthermore, in the latter case, a sealing effect cannot be achieved unless the pressure within the swirl chamber becomes higher than, or equal to, a predetermined value. Therefore, a problem is encountered in a sealing ability.

SUMMARY OF THE INVENTION

The present invention has been worked out for solving the problems in the prior art, set forth above. Therefore, it is an object of the present invention to provide a water pump which can avoid leakage of moisture toward a bearing through a mechanical seal, and also can firmly form a sealing structure for the housing.

Another object of the present invention is to provide a manufacturing method of a water pump as set forth above.

According to the first aspect of the present invention, a water pump comprises:

- a pump housing;
- a rotary shaft supported at an intermediate portion by a bearing mounted on a boss portion of the pump housing;
- an impeller fixed on an end portion of the rotary shaft extending into a swirl chamber defined within the pump housing;
- a mechanical seal disposed between the impeller and the bearing;
- a seal ring disposed within a space defined between the mechanical seal and the bearing for dividing the space into a first and second vapor chambers; and
- drain holes provided for respective first and second vapor chambers.

In the preferred construction, the water pump may further comprise a reinforcement sleeve provided on the boss portion of the pump housing and supporting the bearing and the mechanical seal, and a flange provided within the reinforcement sleeve and holding the seal ring. In the alternative, the water pump may further comprise a reinforcement sleeve provided on the boss portion of the pump housing and supporting the bearing and the mechanical seal, a support sleeve serving as a mechanical seal metal on the inside of the end portion of the reinforcement sleeve on the side of the swirl chamber, on the support sleeve, the mechanical seal being assembled, and the seal ring being engaged within the reinforcement sleeve.

According to the second aspect of the present invention, a manufacturing method of a water pump comprises the steps of:

- slitting an outer periphery of a disc or a disc formed with a support cylinder portion at a center portion, by way of roll spinning;
- widening the slit portion toward both sides into cylindrical-shaped configuration for forming a reinforcement sleeve;
- inserting the reinforcement sleeve in a boss portion of a pump housing upon molding the pump housing; and
- internally providing a bearing, a mechanical seal and a seal ring within the reinforcement sleeve.

According to the third aspect of the present invention, a manufacturing method of a water pump comprises the steps of:

- slitting an outer periphery of a disc or a disc formed with a support cylinder portion at a center portion, by way of roll spinning;
- widening the slit portion toward both sides into cylindrical-shaped configuration for forming a reinforcement sleeve;
- inserting the reinforcement sleeve in a boss portion of a pump housing upon molding the pump housing; and
- internally providing a bearing, a mechanical seal and a seal ring within the reinforcement sleeve in such a manner that the seal ring being disposed between the bearing and the mechanical seal for defining first and second vapor chambers with drain holes.

With the construction set forth above, moisture within the swirl chamber leaking toward the bearing in a form of water vapor, at first, flows into the first vapor chamber to be discharged to the outside through a drain hole. The first vapor chamber 11*a* is thus maintained at atmospheric pressure to produce little leakage of moisture from the first vapor chamber to the second vapor chamber. Furthermore, the moisture penetrated into the second vapor chamber is discharged through the drain hole therein. In addition, the rotary shaft is also supported by the seal ring at the intermediate position between the bearing and the mechanical seal.

BRIEF DESCRIPTION OF THE DRAWINGS

The present invention will be understood more fully from the detailed description given here below and from the accompanying drawings of the preferred embodiment of the present invention, which, however, should not be taken to be limitative to the invention, but are for the purpose of explanation and understanding only.

In the drawings:

FIGS. 5A, 5B, 5C and 5D are explanatory illustrations showing the manufacturing process of a reinforcement cylinder;

FIGS. 7A, 7B, 7C, 7D and 7E are explanatory illustrations showing the manufacturing process of a reinforcement cylinder.

DESCRIPTION OF THE PREFERRED EMBODIMENT

Figure 1:
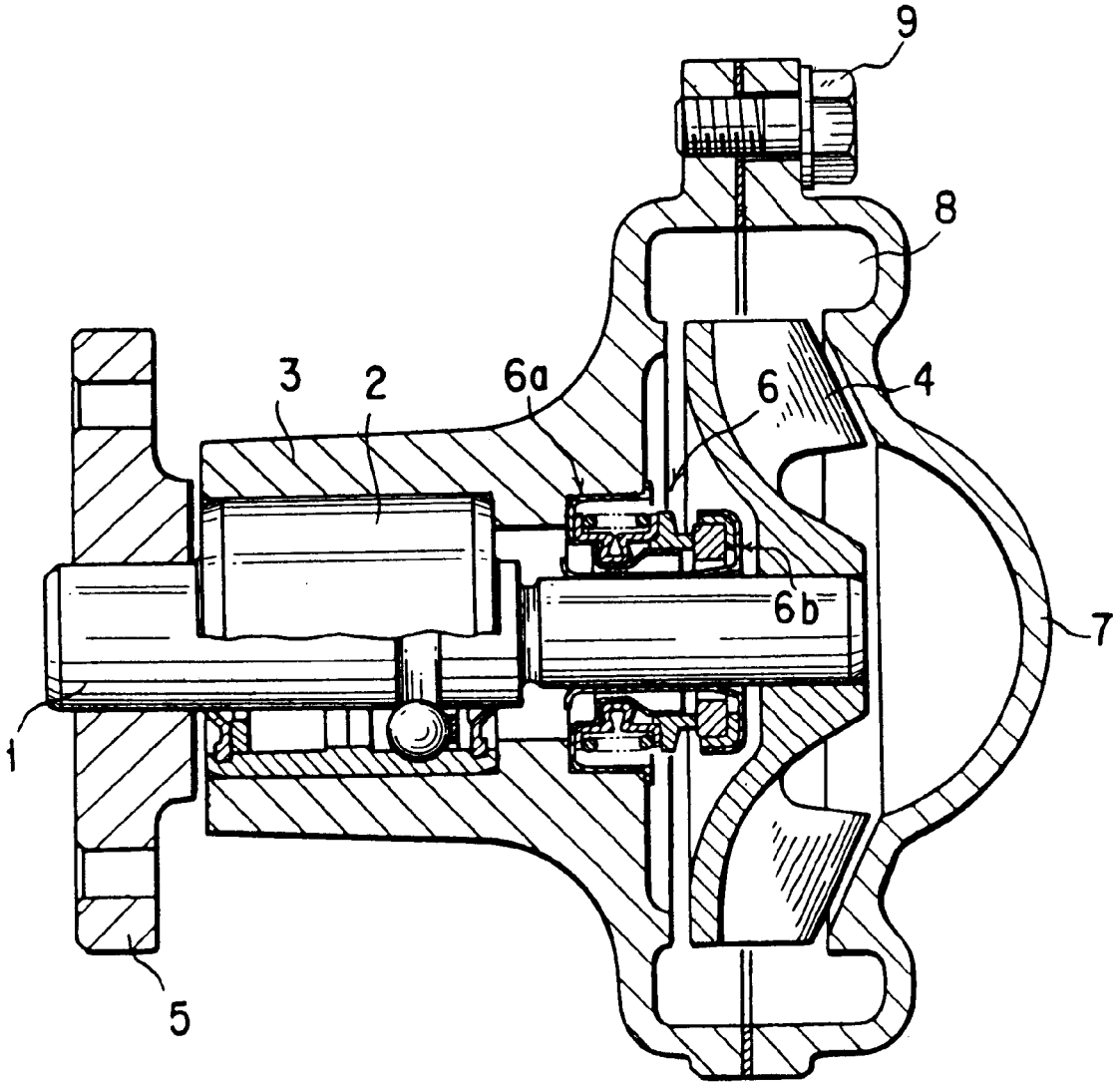
FIG. 1 PRIOR ART
FIG. 1 is a sectional view showing the conventional water pump.

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instances, well-known structures are not shown in detail in order to avoid unnecessarily obscure the present invention.

The preferred embodiment of a water pump according to the present invention will be discussed with reference to FIG. 2 and subsequent drawings. In the following disclosure, like components to those in the conventional construction set forth above will be identified by like reference numerals. It should be noted that, in FIG. 2 and subsequent drawings, a lid body forming the swirl chamber is omitted for the purpose of illustration and in order to avoid unnecessary redundancy.

Figure 2:
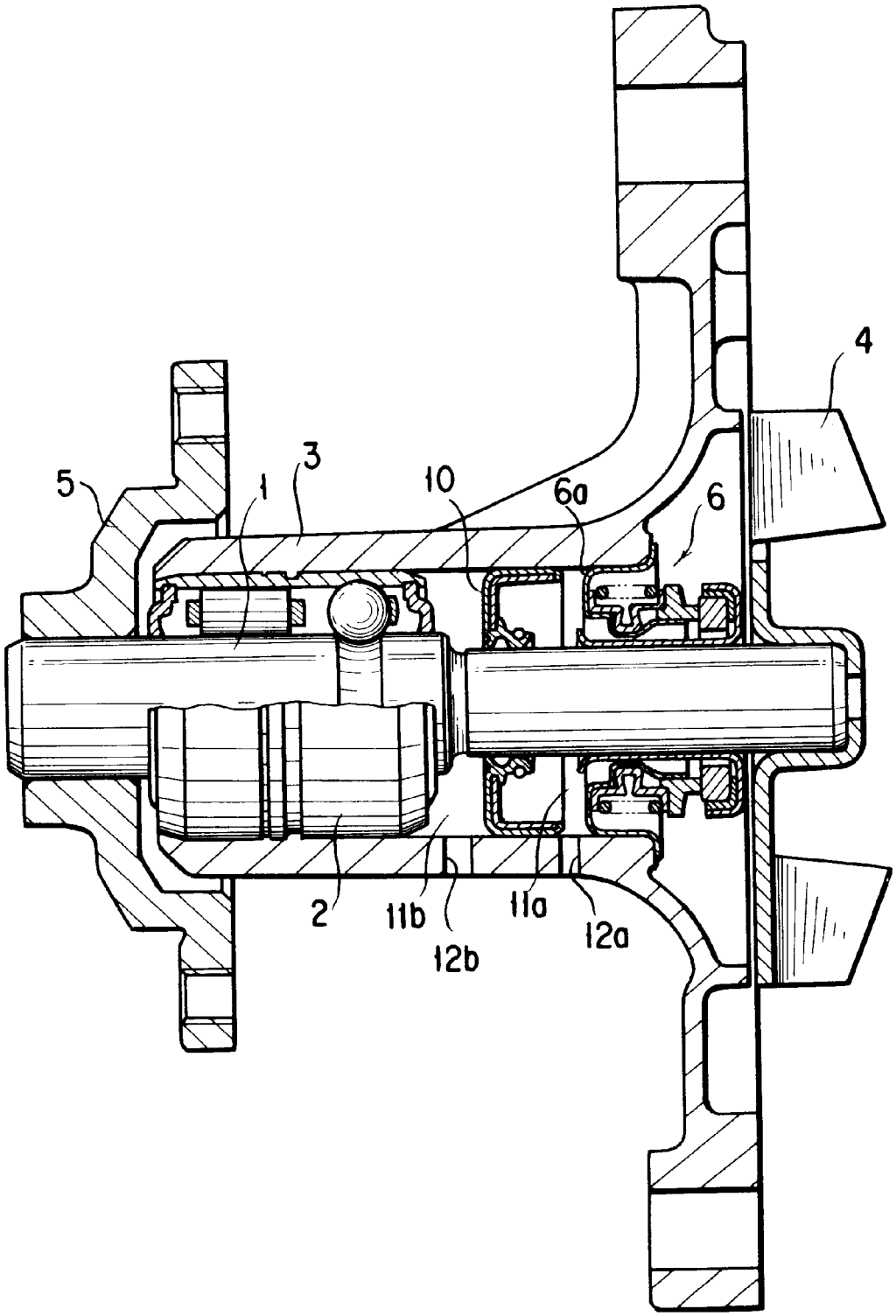
FIG. 2 is a section of the first embodiment of a water pump according to the present invention.

In the first embodiment, shown in FIG. 2, a pump housing 3 is formed of aluminum or aluminum alloy. On an inner surface of a boss portion of the pump housing 3, a bearing 2 supporting a rotary shaft 1 and a stationary member 6*a* of a mechanical seal 6 are engaged and supported. Between the bearing 2 and the mechanical seal 6, a seal ring 10 having a sealing portion thereof engaged with the outer periphery of the rotary shaft 1, is disposed. A space between the bearing 2 and the mechanical seal 6 is divided by the seal ring 10 to define first and second vapor chambers 11*a* and 11*b* from the near side of the mechanical seal 6. In the lower portions of respective vapor chambers 11*a* and 11*b*, drain holes 12*a* and 12*b* communicated with the outside, are provided.

In this construction, the moisture leaked from the mechanical seal 6 toward the bearing 2 in a form of vapor, at first, flows into the first vapor chamber 11*a* divided by the seal ring 10 provided between the mechanical seal 6 and the bearing 2, and then is discharged from the drain hole 12*a*, or is cooled to be dew condensed to be a water droplet to be drained to the outside from the drain hole 12*a*.

The vapor in the first vapor chamber 11*a* is at atmospheric pressure. Therefore, a water leakage pressure from the first vapor chamber 11*a* to the second vapor chamber 11*b* is substantially zero. Then, the moisture leaked from the first vapor chamber 11*a* toward the second vapor chamber 11*b* is drained or discharged from the second vapor chamber 11*b* through the drain hole 12*b*.

Since moisture leaked from the first vapor chamber 11*a* to the second vapor chamber 11*b* is little, the end portion of the bearing 2 facing the second vapor chamber 11*b* is not substantially affected by the moisture. Therefore, the seal member provided on the end portion of the bearing 2 is not deteriorated by the moisture.

In the construction set forth above, an intermediate portion of the rotary shaft 1 extending into the swirl chamber from the bearing 2, is supported by the seal ring 10. By this, a load on the bearing 2 can be reduced to extend a life of the bearing 2.

Figure 3:
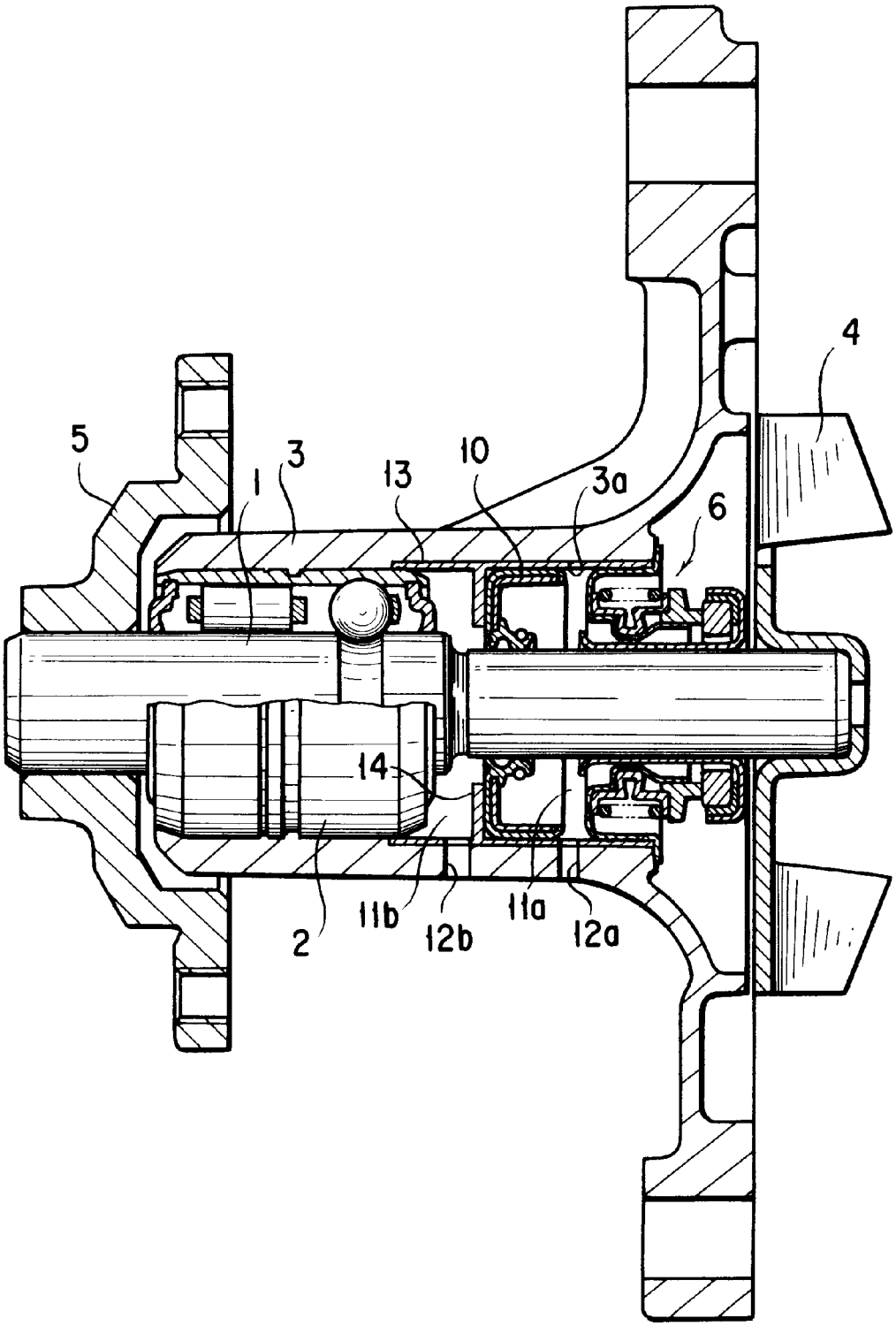
FIG. 3 is a section of the second embodiment of a water pump according to the present invention.

In the embodiment shown in FIG. 3, the pump housing 3 is formed of a plastic material. On the inner surface of support hole 3*a*, a reinforcement sleeve 13 for reinforcing the boss portion of the pump housing 3 is provided by way of insert molding. On the reinforcement sleeve 13, a part of the bearing 2 and the mechanical seal 6 are engaged and held. On the inner periphery of the intermediate portion of the reinforcement sleeve 13, an inwardly projecting flange 14 is provided. Along the flange 14, a seal ring 10 is engaged for defining first and second vapor chambers 11*a* and 11*b* between the mechanical seal 6 and the bearing 2.

Figure 4:
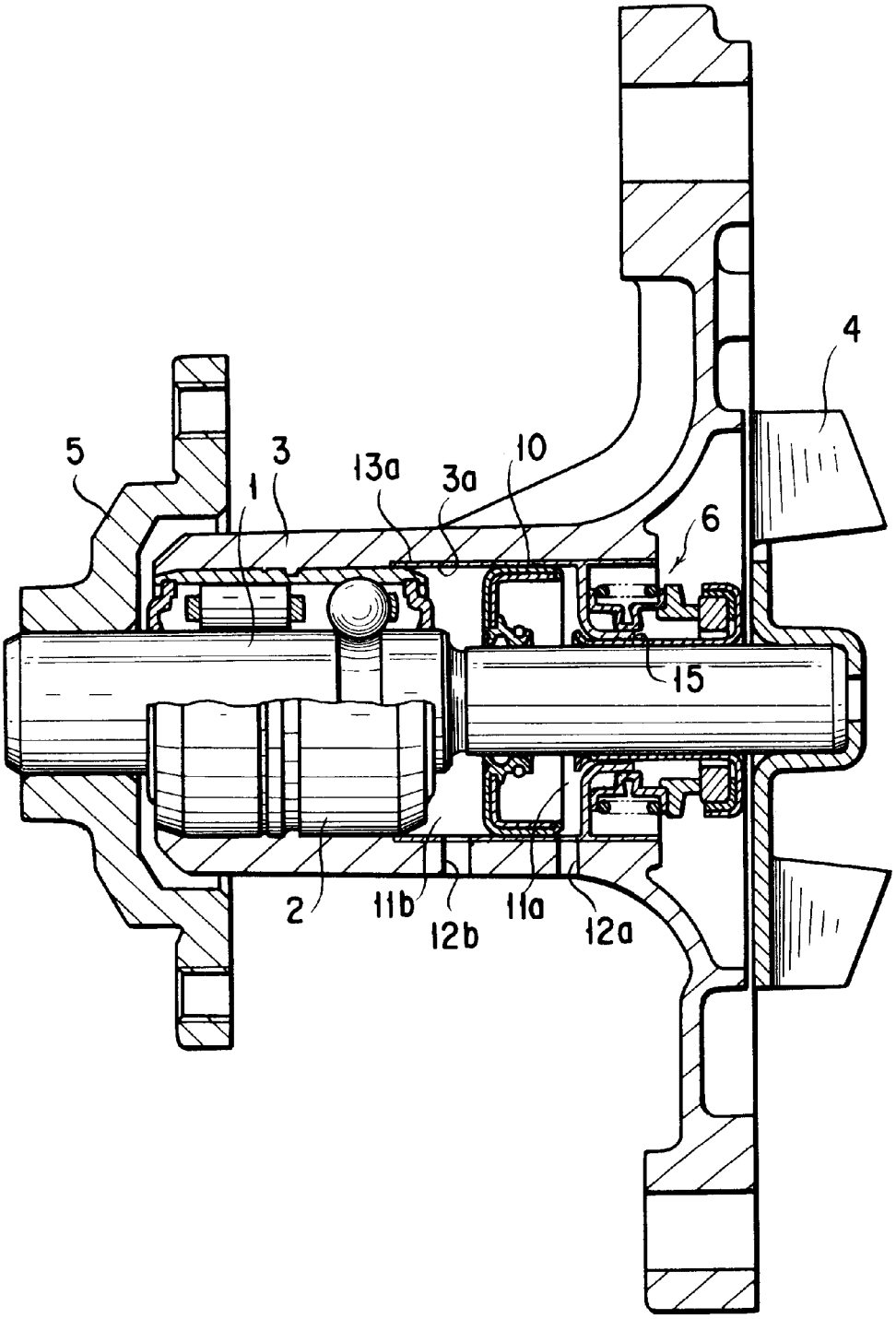
FIG. 4 is a section of the third embodiment of a water pump according to the present invention.

The embodiment shown in FIG. 4 is a modification of the embodiment shown in FIG. 3. On the inner side of the reinforcement sleeve 13*a*, a support sleeve 15 is provided. The support sleeve 15 supports the mechanical seal 6. By this, the support sleeve 15 serves for fixing the mechanical seal 6 fixed on the housing. The seal ring 10 defining the first and second vapor chambers 11*a* and 11*b* is engaged on the inner surface of the reinforcement sleeve 13*a*.

Among the reinforcement sleeves 13 and 13*a*, the reinforcement sleeve 13 having the flange 14 supporting the seal ring 10 is produced through the process illustrated in FIGS. 5A, 5B, 5C and 5D.

At first, a disc 16 having a predetermined diameter is prepared (FIG. 5A). The disc 16 is then clamped by clamps 17*a* and 17*b*. The peripheral portion of the disc 16 is slit by a slitting roller 18*a* of a spinning rolling machine (FIG. 5B). Subsequently, the slit portion clamped by the clamps 17*a* and 17*b* is widened toward both sides in the axial direction by means of a plain roller 18*b* and thus formed into a cylindrical-shaped configuration. Subsequently, the center portion of a clamped portion is punched to form the flange 14 (FIG. 5C). Thereafter, a length of the cylindrical portion relative to the flange 14 is determined to cut both ends into a predetermined length of the cylindrical portion from the flange 14 to form the reinforcement sleeve 13.

Figure 6:
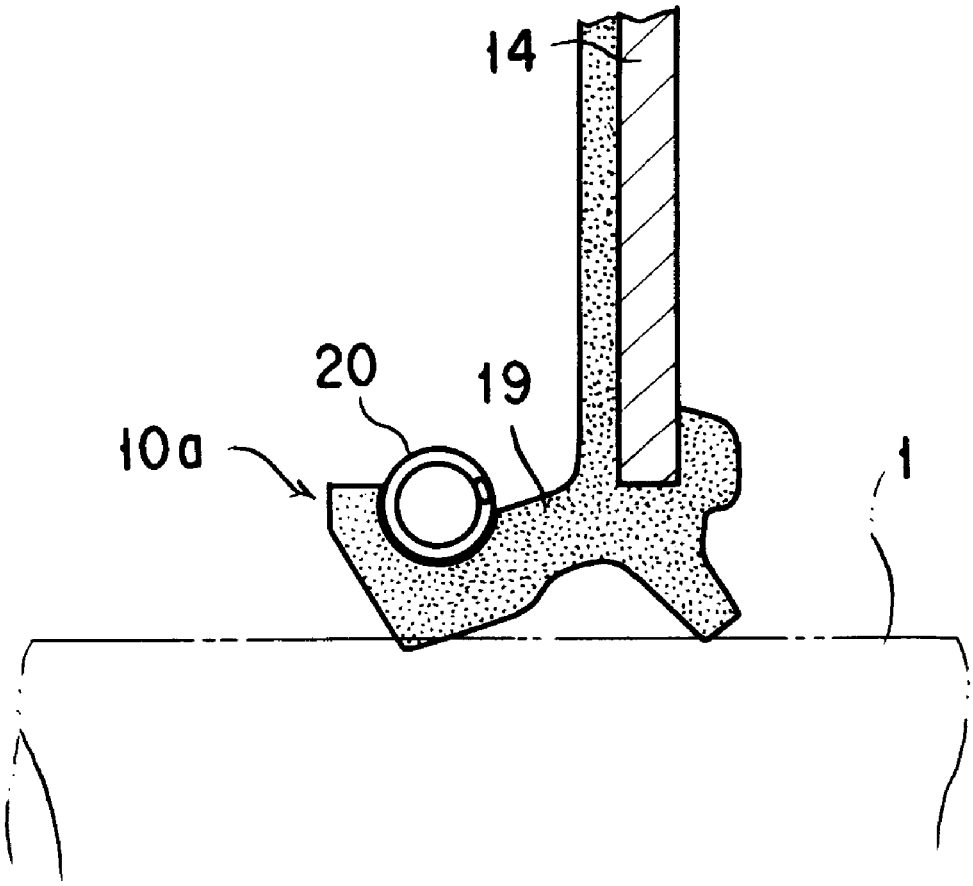
FIG. 6 is a section showing a modification of a sealing ring.

In case of the reinforcement sleeve 13 thus formed, it is possible to bake a seal ring 10*a* consisting of a seal member 19 made of a rubber material and a ring spring 20 on the flange 14, without using the seal ring 10 alone, as shown in FIG. 6.

Furthermore, the reinforcement sleeve 13*a* having a support sleeve 15 on the inner side, is produced through the process steps illustrated in FIGS. 7A, 7B, 7C, 7D and 7E.

At first, a disc 21 having a predetermined diameter is prepared (FIG. 7A). Then, an axial center portion of the disc 21 is punched to form a support sleeve 15 (FIG. 7B). Then, by clamping the disc, the peripheral portion is slit by a slitting roller of the spinning rolling machine (FIG. 7C). Thereafter, the slit portion is widened toward both sides in the axial direction by means of a plain roller to form into a cylindrical-shaped configuration (FIG. 7D). Then, a length of the cylindrical portion for the support sleeve 15 is determined to cut both ends of a predetermined length from the support sleeve 15 to form the reinforcement cylinder 13*a*.

The reinforcement cylinders 13 and 13*a* thus prepared can have the cylindrical portion having an thinner thickness with light in weight, while the flange 14 and the support sleeve 15 having necessary thickness are formed integrally in the inside.

As set forth above, according to the present invention, the moisture leaking from the swirl chamber toward the bearing, can be trapped in the first and second vapor chambers and discharged or drained to the outside therefrom. Thus, the adverse effects of the moisture on the bearing can be successfully avoided. Also, deterioration of the seal rubber provided on the end portion on the side of the swirl chamber of the bearing by the moisture can be prevented to extend the life of the bearing. Furthermore, the rotary shaft is supported not only by the bearing and the mechanical seal, but also by the seal ring therebetween to reduce the load exerted on the bearing.

Then, the foregoing effect can be achieved by a simple construction, in which the seal ring is simply disposed between the mechanical seal and the bearing. Thus, excessive increase of the cost can be avoided.

Furthermore, a manufacturing method of the water pump provided with the reinforcement sleeve in the boss portion of the pump housing, is formed into the cylindrical-shaped configuration by roll spinning from the disc. By this, the reinforcement sleeve having the flange and the support sleeve inside thereof, can be formed with thin wall thickness and be light in weight.

Although the present invention has been illustrated and described with respect to exemplary embodiments thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed and equivalents thereof with respect to the feature set out in the appended claims.

What is claimed is:

1. A water pump comprising:

a pump housing;

a rotary shaft supported by a bearing mounted on a boss portion of said pump housing;

an impeller fixed on an end portion of said rotary shaft extending into a swirl chamber defined within said pump housing;

a mechanical seal disposed between said impeller and said bearing;

a seal ring disposed within a space defined between said mechanical seal and said bearing for dividing said space into a first and second vapor chambers; and permanently open drain holes provided for respective said first and second vapor chambers.

2. A water pump as set forth in claim 1, which further comprises:

a reinforcement sleeve provided on said boss portion of said pump housing and supporting said bearing and said mechanical seal; and a flange provided within said reinforcement sleeve and holding said seal ring.

3. A water pump as set forth in claim 1, which further comprises:

a reinforcement sleeve provided on said boss portion of said pump housing and supporting said bearing and said mechanical seal;

a support sleeve serving as a mechanical seal metal on the inside of the end portion of said reinforcement sleeve on the side of said swirl chamber, on said support sleeve, said mechanical seal being assembled; and said seal ring being engaged within said reinforcement sleeve.

* * * * *